United States Patent [19]

McClusky

[11] 4,137,855

[45] Feb. 6, 1979

[54] TRANSFER MEANS FOR A PLIANT BAG HAVING CONTENTS THEREIN

[76] Inventor: Stanley A. McClusky, Box 188, Edison, Calif. 93220

[21] Appl. No.: 808,283

[22] Filed: Jun. 20, 1977

[51] Int. Cl.[2] ..... D05B 13/02

[52] U.S. Cl. ..... 112/11; 53/139; 141/166

[58] Field of Search ..... 112/11, 10; 53/139, 53/257; 141/166, 314

[56] References Cited

U.S. PATENT DOCUMENTS

| | | | |
|---|---|---|---|
| 1,403,874 | 1/1922 | Seymour | 112/11 |
| 2,037,200 | 4/1936 | Rosmait | 112/11 |
| 2,054,279 | 9/1936 | Briggs | 141/166 X |
| 2,097,450 | 11/1937 | Cundall et al. | 112/11 |
| 2,164,501 | 7/1939 | Cundall et al. | 112/11 |
| 2,275,335 | 3/1942 | Achatz | 141/166 |
| 2,763,109 | 9/1956 | Baker | 141/166 X |
| 3,527,180 | 9/1970 | Cerioni | 112/11 |

*Primary Examiner*—H. Hampton Hunter

*Attorney, Agent, or Firm*—Poms, Smith, Lande, Glenny & Rose

[57] ABSTRACT

A device or attachment for a bag filling and weighing machine in which filled bags of pliant material and containing discrete articles are transferred from the filling machine to a bag closing means including sewing head means and wherein a filled bag is moved in upright position with the upper end of the bag secured in a bag holder and then released from the bag holder for movement in upright position to the sewing head means. The transfer device includes a pair of endless chains having inboard lays which extend from the vicinity of the release of the bags from the bag holder to the reengagement of the bag by bag closing means. The endless flexible members include pointed elements which penetrate and engage upper wall portions of the bag above the contents thereof and below the bag holder so as to retain and guide upper wall portions of the pliant bag to the bag closing means. A bag holder having a pointed rod extending therefrom for engagement of excess bag material while the bag is being transferred from the bag holder to the bag closure means.

13 Claims, 6 Drawing Figures

TRANSFER MEANS FOR A PLIANT BAG HAVING CONTENTS THEREIN

BACKGROUND OF THE INVENTION

Discrete articles of produce, such as potatoes, carrots and the like, are often processed and prepared for shipment by passing such articles through a receptacle or bag filling and weighing machine where each bag is filled to a predetermined weight. Machines for accomplishing such bag filling are well-known; one of such machines is shown in my U.S. Pat. No. 3,554,146 issued Jan. 12, 1971. In the bag filling and weighing machine disclosed in said patent, flexible pliant bags of burlap or netlike material are held with their open ends clamped on a hollow bag holder through which the articles are fed into the bag. When the bag is filled to its selected weight, the bag is released from the holder and conveyed in an upright position to a machine for closing and sewing the top of the bag. In said patent the bag closure means comprises a pair of opposed chain lays located adjacent to each other and between which the upper portion of the bag may be held in closed position and in a condition for presentation to a sewing head.

Between the point of release of the filled bag from the bag holder and the point where the upper portion of the bag is engaged by the bag closure means, there is a short distance that the bag must travel. At this location, an operator usually held the upper bag portions as the bag was released from the bag holder and guided the upper bag portions to the bag closure chains. This operator often had responsibility for assuring that the bag closure means presented the upper bag portion to the sewing head in proper position so that it could be sewed. When such a machine was cycling at normal rate, the distance from the release point on the bagging machine to the sewing head was often too great for one man to assist the bags as released from the bagging machine to the bag closing chains and at the same time service the sewing head operation because of the distance involved. The presentation of the upper portion of the flexible pliant bag at proper elevation to the bag closing chains was necessary to provide a snug bag closure in which slack bag walls were avoided and a relatively tight pack of the articles was provided. It is desired that the walls of the bag snugly fit over the contents of the bag to limit relative movement between the discrete articles therein and possible abrasion and damage to the articles.

SUMMARY OF INVENTION

The present invention contemplates a device which is readily adapted to receive a bag as it is released from the bag holder on such a bag filling and weighing machine and hold the upper portions of the bag walls in upright position until the upper bag wall portions are introduced to the bag closure means without the assistance of an operator.

Generally speaking, the present invention relates to bag wall support means comprising a pair of endless chain members arranged with inboard lays in parallel spaced relation and at one end thereof adjacent to a bag holder at the release vicinity of the bag from the holder. The lays of the chain members are provided with a plurality of spaced pointed elements adapted to penetrate the flexible pliant wall material of the upper portion of the bag on opposite sides thereof and to thereby hold the upper bag wall portions in release position as the bag is moved and transferred to the bag closure chain means. The opposite end of the inboard lays terminates after the beginning of the bag closure chain means so that the upper bag wall portions are held and transferred to the bag closure means at approximately the same level as that at which the bag was released from the bag holder.

The primary object of the present invention therefore is to provide a bag wall support means for holding and guiding upper bag wall portions during movement of the bag between a release position from one machine to an engagement position by another machine.

An object of the invention is to provide a novel device readily attachable to bag filling and weighing machines for transfer of filled bags to bag closure means.

Another object of the present invention is to provide such a bag transfer means wherein a pair of endless chains are provided with outwardly projecting pointed elements for engagement and penetration of pliant walls of a bag having contents therein and transported in upright position.

Another object of the present invention is to provide a device readily attachable to existing bag filling, weighing and closing equipment and which may be readily adjusted to engage a bag released from a bag filling machine and to transfer the bag to a bag closure machine.

A further object of the present invention is to provide means on a bag holder cooperable with bag transfer means for positioning upper wall portions of a flexible pliant bag at a position to be readily engaged by the bag transfer means.

A more specific object of the invention is to provide a pointed spear-like member on a bag holder upon which may be gathered excess material of an upper bag wall portion for vertically locating such material for engagement by the bag transfer means of this invention and for release thereof for transfer to bag closing means.

Many other advantages and objects of the present invention will be readily apparent from the following description of the drawings in which an exemplary embodiment of the invention is shown.

IN THE DRAWINGS

Figure 1:
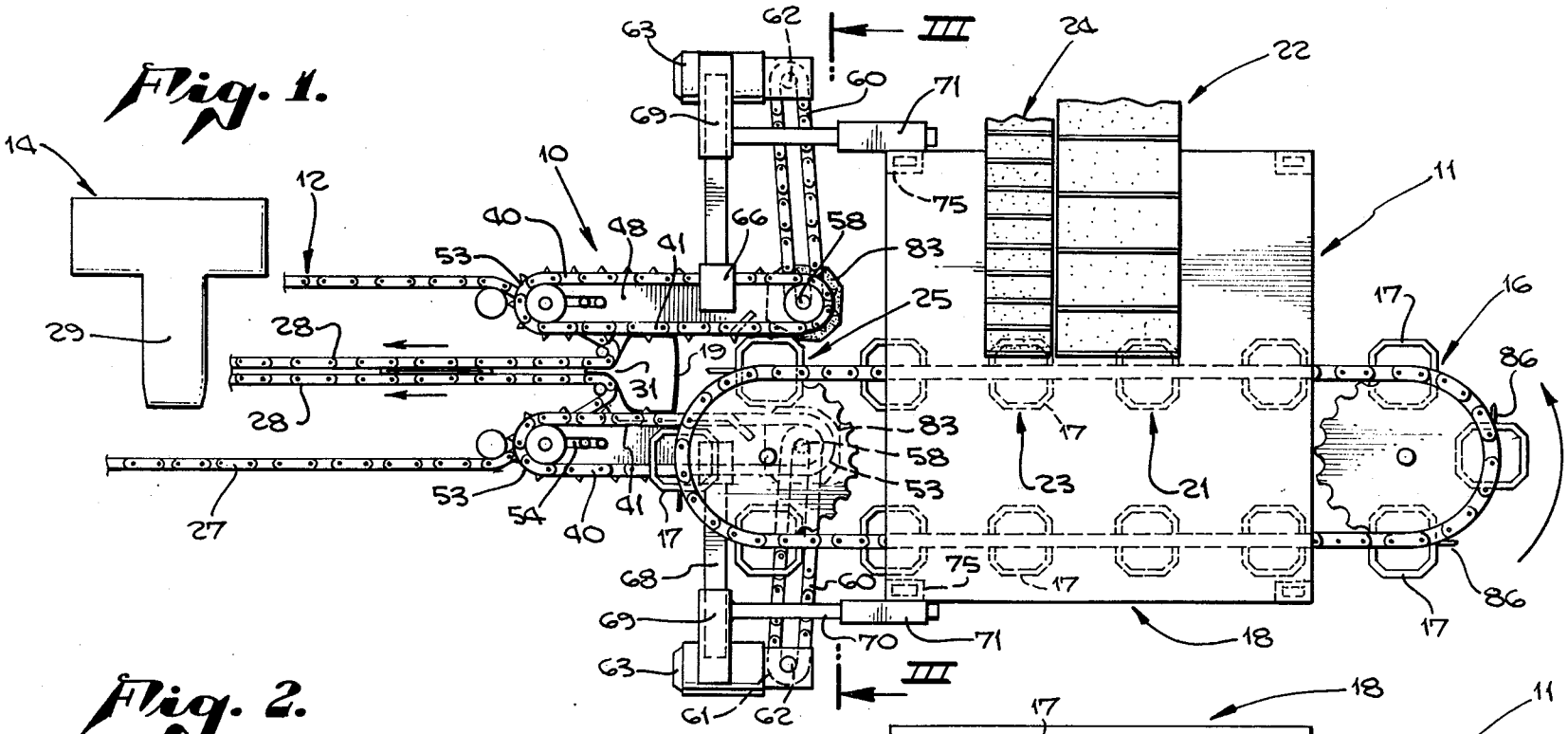
FIG. 1 is a schematic top plan view of a bag filling and weighing machine, transfer means, sewing head, and apparatus of this invention attached to the filling and weighing machine for transfer of filled bags from the machine to the bag closing and transfer means for presentation of the bag to the sewing machine.
Figure 2:
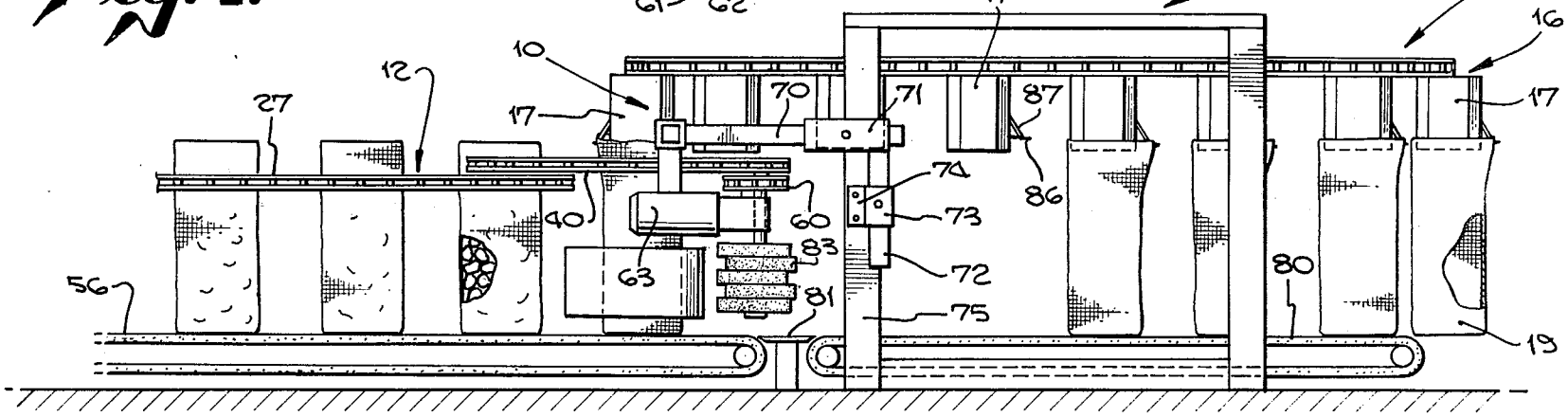
FIG. 2 is a side elevational view of the filling and weighing machine as shown in FIG. 1.

In FIGS. 1 and 2, there is shown a device or apparatus, generally indicated at 10, embodying this invention attached to and associated with a bag filling and weighing machine 11, a bag closure means 12 for presentation of a closed bag to a sewing machine 14. Machine 11, bag closure means 12, and sewing head 14 are disclosed in my U.S. Pat. No. 3,554,146. It will be understood that apparatus 10 embodying this invention may be employed with other types of bag filling and weighing machines where the bags being filled are of flexible, compliant material such as burlap, open mesh material, and the like.

Bag filling and weighing machine 11 generally comprises an endless conveyor system 16 having a plurality of open ended bag holders 17 arranged in spaced intervals and to which flexible bags to be filled may be readily attached at a bag attachment station generally indicated at 18, by slipping the open end of the bag upwardly and around the lower portion of bag holder 17. Suitable clamp means, not shown, hold the bag on the bag holder. Bag holders 17 with bags 19 thereon are intermittently advanced to a bulk feeding station 21 where articles are fed from a bulk feed conveyor through the bag holder 17 into the bag. After bag 19 has been filled to a preselected short or incomplete weight, the conveyor system advances the bag holders 17 and bags 19 attached thereto to a dribble feed station 23 where a dribble feed conveyor 24 feeds articles to the predetermined, final weight. After the bag has been filled at station 23, it is intermittently advanced to a bag release station 25 where cam means provided on the frame of the bag filling and weighing machine coact with the bag clamping means to release the clamping means.

In said U.S. Pat. No. 3,554,146, the released bag conveyed to bag closure means comprising particularly arranged endless chain means 27 arranged to provide closely adjacent inboard chain lays 28 adapted to hold upper portions of the released bag in linearly closed relation for presentation to a sewing head 29 arranged in the path of the closed upper portions of the bag to sew the bag in closed position. As previously mentioned, in the space between the bag release station 25 and the adjacent end of the bag closure means 12, the flexible, pliant upper portions of the bag were required to be supported by an operator for feeding into the bite 31 of the inboard parallel chain lays 28 of the bag closure means 12. It will be understood that the bag holders and bags held thereby are intermittently advanced around the conveyor system. When the bag is released at station 25 and advanced to the bag closure means 12, the filled bag is continuously moved from the bite 31 through the sewing head 29.

Figure 4:
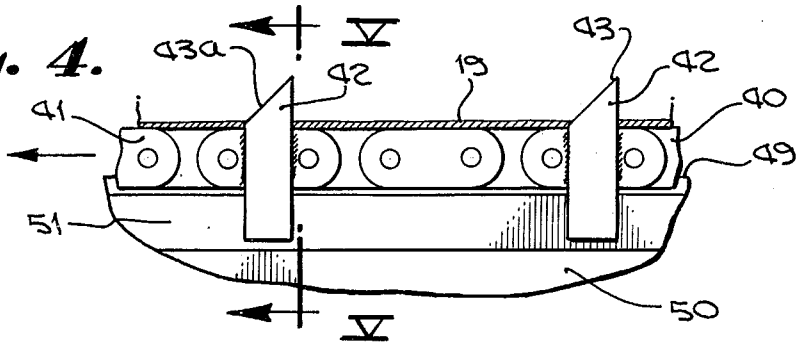
FIG. 4 is an enlarged fragmentary top plan view of bag wall support means of this invention.
Figure 6:
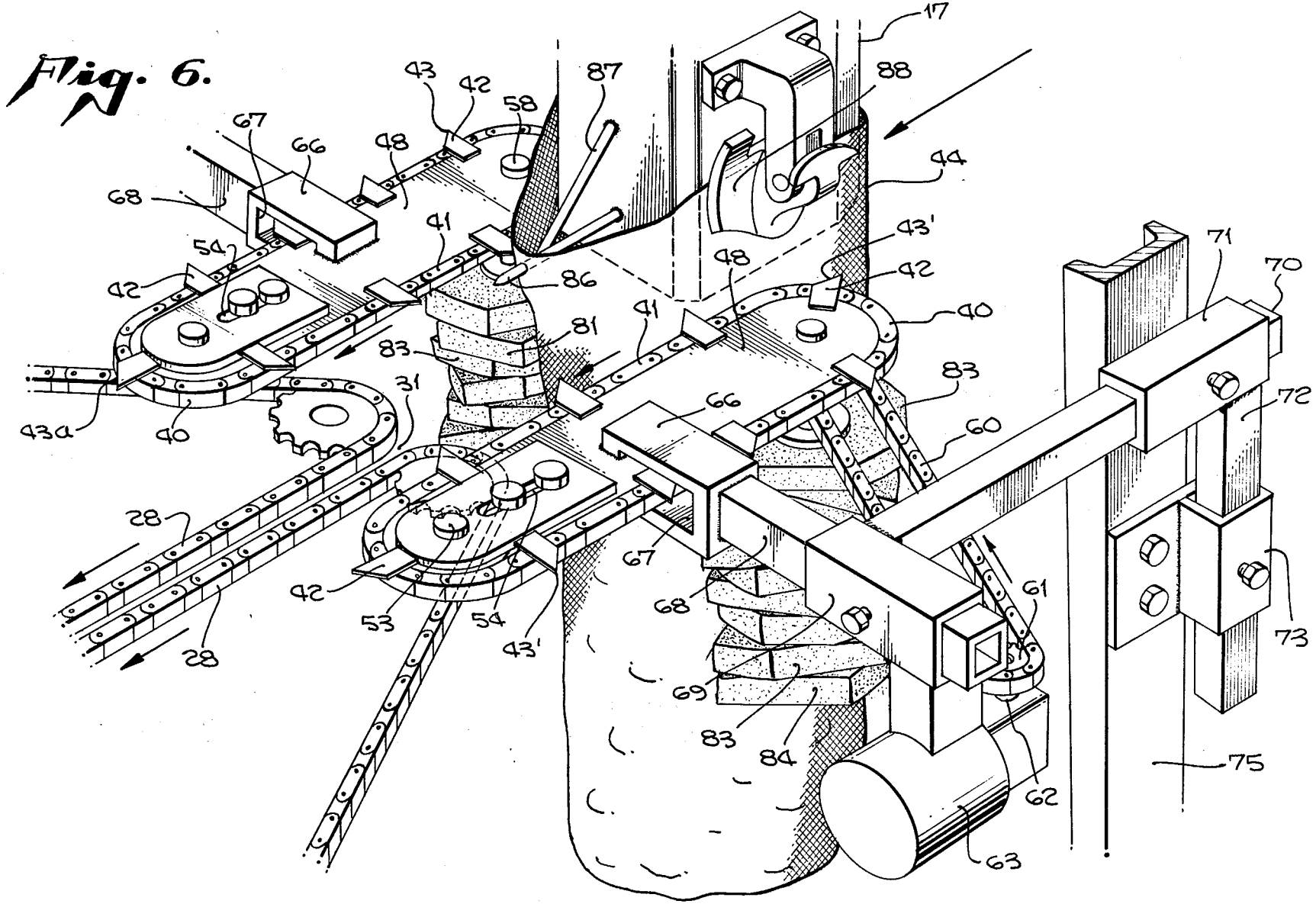
FIG. 6 is a perspective view of the transfer means of this invention.

Apparatus 10 of this invention provides means for holding upper portions of the walls of the filled bag in upright position during transport of the bag from the bag release station 25 to the bite 31 of the bag closure means 12. As best seen in FIGS. 1, 4, 6 apparatus 10 comprises a pair of flexible members 40, such as suitable chain, arranged horizontally and providing inboard lays 41 extending from bag release station 25 to a point beyond bite 31. Inboard lays 41 are spaced apart a distance slightly less than than the width of a bag holder 17 and are vertically located just below the bottom edge of bag holder 17. Flexible members 40 are provided with pointed elements 42 at spaced intervals along said flexible members, the exposed inboardly directed pointed extremities 43 serving to penetrate flexible upper bag portions 44 which extend above the level 45 of the articles in the bag. The pointed elements 42 move with said bag as it leaves the release station and hold the upper bag portions against downward collapse until the upper bag portions are engaged by the bite 31 and then moved into closed position by the inboard parallel lays 28 of the bag closure means 12. In this example, each flexible member 40 is supported by an elongated plate 48 which provides parallel longitudinal edges 49 for guiding and supporting inboard and outboard lays of flexible member 40. On top of plate 48 may be provided a guide strip 50 having a rabbeted edge 51 for cooperation with the end of pointed element 42 opposite from its pointed extremity 43 for supporting the pointed element in substantially horizontal position in cooperation with edge 49. At opposite ends of elongated plate 48, suitable sprocket means 53 are provided for guiding flexible member 40 around the end of plate 48. One sprocket 53 is located above and over bag closure means 12 and suitable adjustment means comprising a slot and bolt assembly 54 is provided for adjusting tension in the flexible members 40.

Means for driving endless flexible members 40 so that the inboard lays 41 move at the same rate of speed in the same direction toward the bite 31 and also move at the same rate of speed as a bottom belt conveyor 56 which supports and contacts the bottom of a filled bag 19, may comprise a drive shaft 58 connected to sprocket 53 at the end of the endless flexible member 40 adjacent bag release station 25. Shaft 58 extends below plate 48 and carries a drive gear 59 driven by a drive chain 60 connected to a drive gear 61, supported by a shaft 62, driven by a suitable electric motor 63, synchronized with the drive means for the bag closure means 12 and the bag support conveyor 56. In this example, such a drive means is provided for each flexible member 40 and such drive means are synchonized with each other and with the drive means for the bag closure means 12 and conveyor belt 56. It will be understood that other drive means, such as a single drive means, may be used to drive both flexible members 40 at the same rate of speed.

Means for supporting, attaching, and adjusting the endless flexible members 40 and the drive means associated therewith to the frame of the bag filling and weighing machine 11 may comprise a yoke member 66 which receives in yoke opening 67 an outboard edge portion of plate 48 and flexible member 40, said yoke member 66 being welded to plate member 48 or secured in suitable manner. Yoke member 66 is supported on a horizontal arm 68 of square, hollow cross section which is receivable in a square section sleeve 69, which supports the motor means 63. Arm 68 is longitudinally, slidably adjustable in hollow sleeve 69 and secured as by set screws or bolts to precisely position the inboard lays 41 of the flexible members with respect to the upper portion of the bag walls at the release station 25. A support arm 70 extends longitudinally of the machine 11 and is fixed to sleeve 69 and extends through a hollow box section support sleeve 71 for slidable adjustment of the flexible members 40 longitudinally of the machine 11 and bag closure means 12. Sleeve 71 is carried by a vertically extending box section support member 72, which is received within a hollow box section support sleeve 73 and is slidably vertically adjustable with respect thereto to permit adjustment of the vertical height of flexible members 40. Sleeve 73 is provided with a securement flange 74, which may be bolted to an upstanding frame member 75 of the bag filling and weighing machine 11.

It will thus be apparent that the apparatus 10 of this invention may be readily attached to a frame structure of a bag filling and weighing machine and suitably three-dimensionally adjusted for aligning the inboard lays 41 of the flexible members in proper relationship with the upper wall portions of a bag at the point of release from the bag holder at release station 25 and for carrying and holding the upper wall portions of the bag to the bite 31 of the bag closure means 12.

Filled bags 19 may weigh between 50 to 100 pounds and after filling at fill stations 21 and 23, the bottom of the bag is supported on an endless conveyor 80 which is aligned with conveyor 56 and which moves intermittently in accordance with the intermittent movement of the bag holder conveyor means, while conveyor belt 56 moves continuously in accordance with the movement of the bag closure means 12. To facilitate the transfer of a supported bag from conveyor 80 to conveyor 56, a suitable transfer apron 81 or a plurality of idle rollers may be interposed between the adjacent ends of the conveyors 80 and 56.

Figure 3:
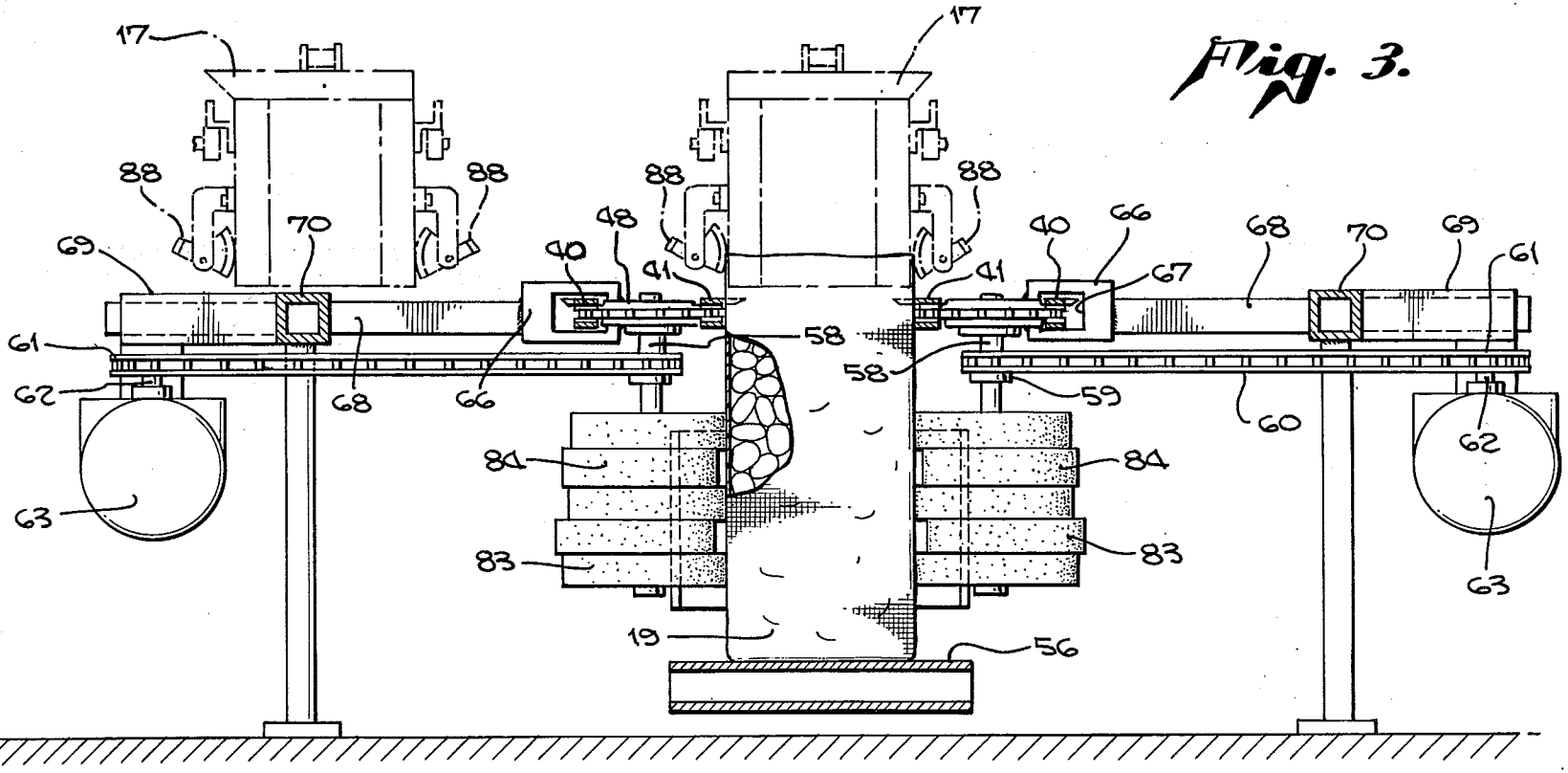
FIG. 3 is a transverse sectional view taken in the plane indicated by line III — III of FIG. 1.
Figure 5:
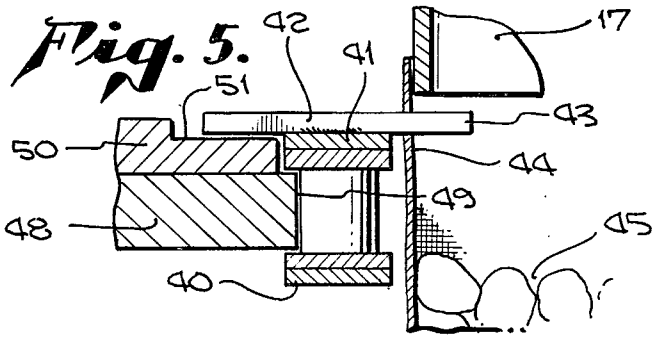
FIG. 5 is a transverse vertical sectional view taken in the plane indicated by line V — V of FIG. 4.

To facilitate the upright support of a filled bag at the bag release station 23 and during its transfer from intermittent motion to continuous motion, a pair of upstanding cylindrical drive rollers 83 are hung from drive shafts 58 and rotatively driven thereby in synchronism with the rate of movement of the inboard lays 41. In FIG. 3, each roller 83 comprises a plurality of discs 84 of generally non-uniform, irregular periphery. Each disc 84 may be cut from suitable plastic foam such as polyurethane or polyethylene foam. The diameter of each disc 84 is selected so that the periphery of the roll 83 will engage and contact a filled bag 19 and aid in supporting said bag as it is released from the bag release station 25 and is transferred to the bag closure means 12. The use of relatively soft, foam material not only provides the necessary support for the side walls of the bag, but also prevents damage to articles of produce which may be in the bag.

Bag filling and weighing machine 11 may be used to fill bags of different size, such as 50 lb. or 100 lb. bags. Also, different diameter bags may be used with the bag filling and weighing machine 11. It will be noted that the bag holders 17 are of fixed diameter and circumference and occasionally a bag of greater diameter may be desired to be filled on said machine. Under such circumstances, the bag supporting conveyors 80 and 56 may be elevated by suitable means so that they can contact the bottom of the bag when filled.

When a bag having a diameter or a circumference of its upper portion greater than the circumference of a bag holder 17 is sleeved over the bottom portion of the bag holder, excess material, because of the bags enlarged size, may be gathered and held by piercing the excess material with a horizontally, forwardly extending rod 86 fixedly secured to each holder 17 as by welding and supported by a diagonal brace member 87. The height of rod 86 above the bottom edge of bag holder 17 is approximately the same height as that of the bag clamping means 88 so that the upper portions of the bag are held at approximately the same level.

As the bag is filled, the articles in the bag will cause the flexible, pliant material of the bag to expand outwardly. When the bag reaches the bag release station 25, clamping means 88 are released, and the pointed, flexible members 40 have engaged the upper portion of the bag. At the release station, the filled bag is advanced by the supporting belt 56 and by the movement of the inboard lays 41 toward the bag closure means. Since the movement of the bag holders is intermittent, the bag holder 17 at the release station will be stationary at approximately the moment of release of the bag so that the folded material of the bag carried by the pointed element 86 will be stripped from element 86 by the motion of the inboard lays 41 and the movement of the filled bag on the continuously moving conveyor 56. Such movement is also assisted by the rotative movement of the rolls 83.

Thus, the provision of the pointed member 86 to hold and carry gathered upper portions of the bag provides a convenient means for utilizing bags of different size. During transfer of the upper portions of the bag from the release station to the bite 31 of the bag closure means 12, it will be apparent that the inboard lays 41 with pointed elements 42 assist in such transfer without the introduction of sufficient downward movement of the gathered material to cause improper or out of alignment entry of such material into the bite 31 of the bag closure means 12.

It should be noted that pointed extremities 43 of the pointed elements 42 have been shown with an acute angle formed by one side of the element 42 and a diagonal face **43*a* to said side. Diagonal face or edge 43*a* facilitates release of the pointed extremity 43 from the material of the upper portion of the bag as the flexible member 40 carries the side walls of the upper portions of the bag into the bite 31 where the material of the bag is drawn toward the vertical plane defined by the opening between the parallel lays 28 of the bag closure chain means 12. While the bottom edge of the bag holders is illustrated as being in a horizontal plane and the pointed elements 42 lie just below said plane, it will be understood that one of the flexible members 40 may be at an elevation different than the other flexible member 40 in the event the bottom edge of the bag holder on one side is at a different elevation than the bottom edge on the other side of the holder. It is desirable that the pointed elements 42 penetrate and engage the upper bag wall portions just below the bottom edge of the bag holder in order to most effectively transfer the upper bag wall portions to the bite 31 which lies at an elevation slightly below the flexible members 40**.

It will be understood that various modifications and changes may be made in the apparatus described above and which come within the spirit of the invention and all such changes and modifications coming within the scope of the appended claims are embraced thereby.

I claim:

1. In a device for transferring filled pliant flexible bags of discrete articles from a bag filling machine having bag holders moving in a path to a bag closing means and sewing head means spaced from said path for stitching the top portion of the bag into closed position, and wherein a filled bag is moved along said path with the upper end of the bag secured on a bag holder in open position, said bag having pliant walls and extending above the bottom edge of the bag holder, the provision of:

bag wall support means overlapping an end portion of said path and extending between said filling machine and said bag closing means, said bag wall support means being engageable, prior to release of said bag by said bag holder and at said overlapping end portion of said path, with upper pliant bag wall portions in open position below and adjacent the bottom edge of the bag holder on opposite sides of the bag for holding and guiding said upper bag wall portions after release by said bag holder into a position for engagement with said bag closing means for transport to the sewing head means.

2. In a device as claimed in claim 1 wherein said bag wall support means includes an endless chain having one lay of said chain paralleling the path of said bag and located at a level slightly below the bottom edge of the bag holder.

3. In a device as claimed in claim 2 wherein said endless chain includes a plurality of interconnected links, and a plurality of spaced bag engagement means fixed to said links and extending inboardly a sufficient distance to releasably engage said upper pliant wall portions while on said holder.

4. In a device as claimed in claim 3 wherein said bag engagement means includes a pointed element angularly positioned relative to said wall portion and adapted to partially penetrate said upper wall portion of the bag to support such upper wall portion until the wall portion is engaged by the bag closing means.

5. In a device for transferring filled bags of discrete articles from a bag filling machine to a sewing head means for stitching the top portion of the bag into closed position, and wherein a filled bag is moved in upright position with the upper end of the bag secured on a bag holder in open position, said bag having pliant walls, the provisions of:

bag wall support means engageable, prior to release by said bag holder, with upper pliant bag wall portions on opposite sides of the bag for holding and guiding said upper bag wall portions after release by said bag holder into a position for engagement with bag closing means during transport to the sewing head means;

a rigid pointed rod fixed to said bag holder and extending forwardly of said bag holder in the direction of path of travel thereof for engagement with a portion of a bag to be filled;

said portion of the bag fixed by said rod being releasable therefrom by withdrawing of the bag portion therefrom during intermittent movement of the bag holder.

6. An adjustable apparatus for positioning between adjacent spaced ends of transport means for filled pliant bags to transfer a filled upright pliant bag from one transport means to the other transport means, comprising:

a pair of frame structures, each structure including a first frame member adjustably connected to a transport means for longitudinally positioning said frame member relative to said transport means, a second frame member transverse to said first frame member and adjustably connected to said first frame member for lateral positioning of said frame structure relative to said transport means;

an endless flexible member supported from said second frame member and having an inboard lay parallel to and opposite to the inboard lay of the flexible member supported by the other frame structure;

engagement means carried by said endless flexible member to engage upper pliant bag portions while said filled bag is supported by one transport means before transfer to the other transport means;

and drive means on each of said frame structures for said endless flexible members carried thereby for moving said inboard lays at substantially the same speed as the transport speed of a filled bag.

7. An apparatus as stated in claim 6 wherein said one transport means includes a bag holder having a rigid pointed rod extending forwardly of the bag holder for releasable engagement with an upper pliant portion of a bag to be filled.

8. An apparatus as stated in claim 7 wherein said one transport means carrying said bag holder is intermittently movable, said endless flexible members being continuously movable, whereby the upper bag portion engaged by said pointed rod is releasable from said rod by said continuous movement of said endless flexible members.

9. An apparatus as stated in claim 6 wherein said engagement means on said flexible members include spaced elements for penetration of upper pliant portions of said bag while carried by said one transport means for supporting said upper bag portions while transferred to the other transport means.

10. An apparatus as stated in claim 9 wherein said endless flexible members extend into overlapping relation with said other transport means for supporting said upper pliant bag portions, said other transport means including means for engaging and closing said upper bag portions and for release of said upper bag portions from said pointed elements on said endless flexible members.

11. An apparatus as stated in claim 6 wherein said drive means for each endless flexible member on each frame structure includes a shaft carrying a drive sprocket for said endless flexible member, drive chain means for said sprocket, said sprocket having a drive shaft extending downwardly, and generally cylindrical drive rollers carried by said drive shaft and presenting soft irregular roller faces for engagement with sides of a filled bag.

12. In an apparatus as stated in claim 11 wherein said generally cylindrical roller includes a plurality of discs of irregular diameter and of plastic foam arranged in stacked relation on said shaft.

13. A bag holder adapted to be moved intermittently in a selected direction and having a hollow holder body of selected configuration for holding upper portions of a pliant bag in open position, comprising in combination:

means extending from said holder body in said selected direction for holding pliant upper bag portions not conforming to the selected configuration of the holder body in bag open position, said means including a pointed rod extending from a bottom portion of the holder in the direction of movement of the holder and adapted to be released from said pliant bag portions during said intermittent movement.

* * * * *